US012509321B2

(12) United States Patent
Stafford, IV

(10) Patent No.: US 12,509,321 B2
(45) Date of Patent: Dec. 30, 2025

(54) REEL ASSEMBLIES AND METHODS OF MAKING AND USING REEL ASSEMBLIES

(71) Applicant: Walter Alexander Stafford, IV, Murrels Inlet, SC (US)

(72) Inventor: Walter Alexander Stafford, IV, Murrels Inlet, SC (US)

( * ) Notice: Subject to any disclaimer, the term of this patent is extended or adjusted under 35 U.S.C. 154(b) by 12 days.

(21) Appl. No.: 18/614,144

(22) Filed: Mar. 22, 2024

(65) Prior Publication Data

US 2024/0317540 A1 Sep. 26, 2024

Related U.S. Application Data

(60) Provisional application No. 63/453,935, filed on Mar. 22, 2023.

(51) Int. Cl.
*B65H 75/14* (2006.01)
*B65H 75/22* (2006.01)

(52) U.S. Cl.
CPC ..... *B65H 75/14* (2013.01); *B65H 75/2245* (2021.05); *B65H 2701/5112* (2013.01); *B65H 2701/51522* (2013.01); *B65H 2701/51524* (2013.01); *B65H 2701/51526* (2013.01); *B65H 2701/51528* (2013.01)

(58) Field of Classification Search
CPC ..... B65H 75/2245
See application file for complete search history.

(56) References Cited

U.S. PATENT DOCUMENTS 3,235,203 A * 2/1966 Antliff ..... B65H 75/2245 242/610.4
3,323,743 A * 6/1967 Landgraf ..... B41J 33/003 400/242
3,334,840 A * 8/1967 Vander Pyl ..... B65H 75/14 242/118.7
3,398,915 A * 8/1968 Dittrich ..... D02H 13/28 242/118.7
3,940,085 A * 2/1976 Campbell ..... B65H 75/2218 242/608.2
4,083,450 A * 4/1978 La Mar ..... B65H 75/2272 242/608.5
4,412,661 A * 11/1983 Wise ..... B65H 75/14 242/608.4
4,422,595 A * 12/1983 Thomas ..... B65H 75/2263 242/118.61
6,341,745 B1 * 1/2002 Ridgeway, Jr. ..... B65H 75/14 242/608.8

(Continued)

*Primary Examiner* — William A. Rivera
(74) *Attorney, Agent, or Firm* — SMITH TEMPEL; Steven P. Wigmore

(57) ABSTRACT

An improved reel or spool package comprises opposing flange assemblies. Each flange assembly comprises inner and outer parallel members having a connective material in between them. A core interconnects the flange assemblies. One or more rods extends through each end of the center core such that portions of the rods are in contact with the connective material. The connective material connects the inner and outer parallel members of each flange assembly together and holds the rods in place relative to the core and the parallel members. There is no need for additional fastening devices (e.g., bolts, screws, welds, etc.). The resulting package is extremely strong, even if a paper core is used, and can replace wood or metal reels currently used in many applications.

20 Claims, 8 Drawing Sheets

(56) References Cited

U.S. PATENT DOCUMENTS

| | | | | |
|---|---|---|---|---|
| 10,294,066 | B1 * | 5/2019 | Bigbee, Jr. | B65H 75/14 |
| 2008/0217464 | A1 * | 9/2008 | Ridgeway | B65H 75/14 242/600 |
| 2018/0009628 | A1 * | 1/2018 | Echols, Jr. | B65H 75/50 |
| 2024/0409359 | A1 * | 12/2024 | Cahoon | B65H 75/182 |

* cited by examiner

REEL ASSEMBLIES AND METHODS OF MAKING AND USING REEL ASSEMBLIES

CROSS REFERENCE TO RELATED APPLICATIONS

The present application is a U.S. nonprovisional patent application that claims priority to, and the benefit of the filing date of, U.S. provisional patent application having Ser. No. 63/453,935, filed on Mar. 22, 2023, entitled "REEL ASSEMBLIES AND METHODS OF MAKING AND USING REEL ASSEMBLIES", which is incorporated by reference herein.

BACKGROUND

Reel packages and spool packages are used for the packaging of products that are produced in a continuous and connected manner and are frequently packaged in large number or high count continuous lengths for long run use, including automated use. These products are typically packaged in a "ribbon wound" (layer on layer), traverse or convolute manner on a central core of a size closely matching the width of the manufactured product, so that the user of the product may unwind the product in an orderly, controlled manner for use or installation in other products.

Products having a narrow face width may be wound so as to traverse the center core, alternately reversing direction within the confines of the sidewalls. The resulting package has multiple layers of product wound over the core, and between the sidewalls. Long, unbroken lengths of product may be packaged and stored by use of the elongated core with product that is traverse wound. Reels or spools that are useful with this type of packaging may have cores that are relatively long, and/or of relatively large diameter.

Products that are packaged on reels and spools are made of a wide variety of raw materials including metals, plastics, textiles and other products. The stiffness of some continuous products is such that the package must have a core with a relatively large circumference (6" to 20") to prevent undesired curling or bending of the manufactured product. Additionally, packages for these products have sidewalls or flanges which act as retainers to keep the product from slipping off of the core and becoming twisted, bent, damaged or difficult or impossible to use. The sidewalls for larger reels used for relatively rigid products typically range in size from 10" to 48", and are made of corrugated board, solid fibreboard, Masonite, plastic, plywood, or other suitable materials. While there are technical differences between spools and reels as these terms are used in the art, the term "reel" is used herein to indicate reels and spools used for packaging.

There is a need for a lightweight and easy-to-assemble reel that provides exceptional strength. The reel should rival or exceed the strength of metal or wood reels, while being formed of lighter weight and less expensive material, such as paper, fiberboard, cardboard and similar cellulosic materials.

BRIEF DESCRIPTION OF THE DRAWINGS

In the Figures, like reference numerals refer to like parts throughout the various views unless otherwise indicated. For reference numerals with letter character designations such as "101*a*" or "101*b*", the letter character designations may differentiate two like parts or elements present in the same Figure. Letter character designations for reference numerals may be omitted when it is intended that a reference numeral to encompass all parts having the same reference numeral in all Figures.

DETAILED DESCRIPTION

Figure 1:
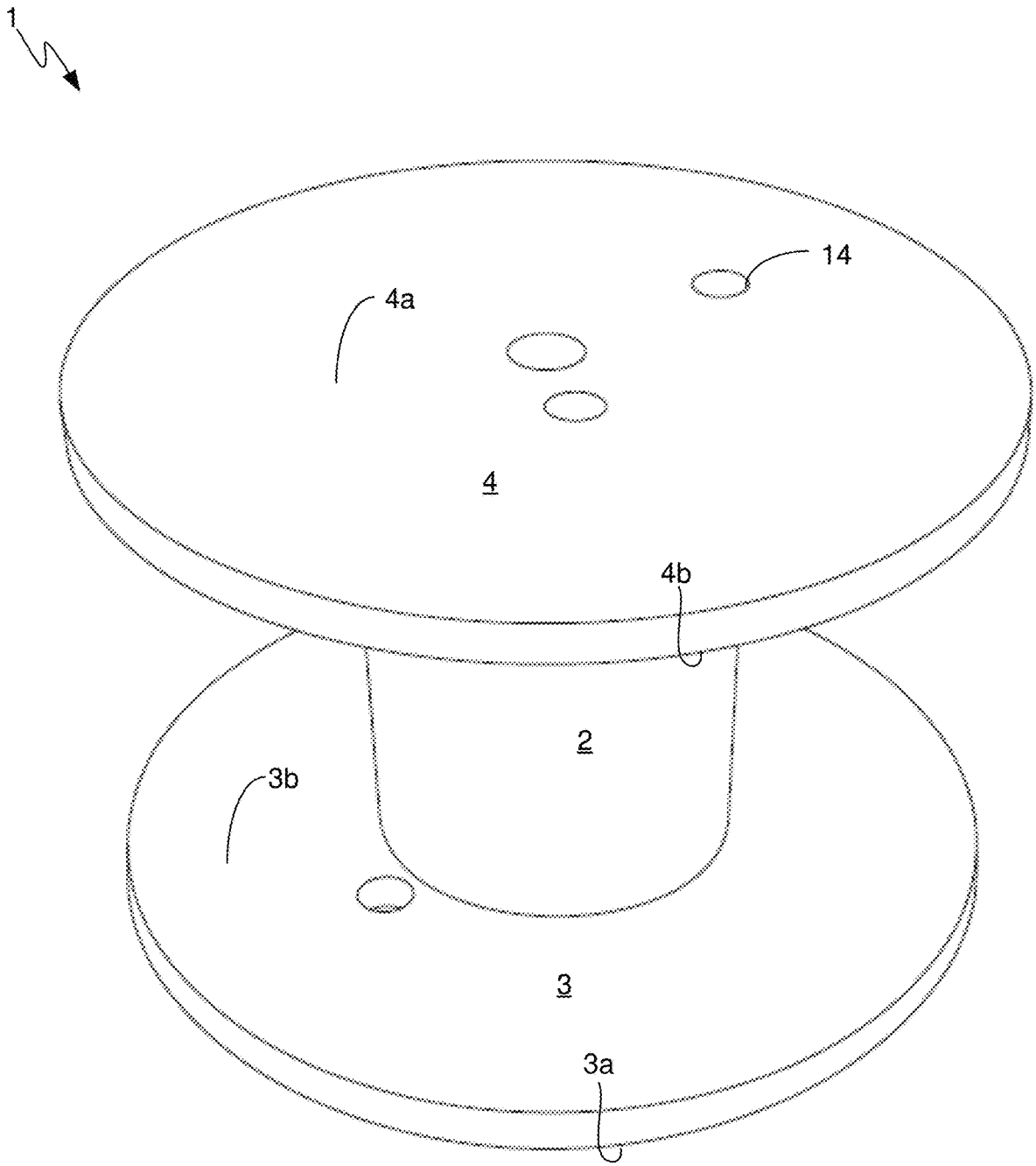
FIG. 1 is a perspective view of a reel according to a representative embodiment.

The present disclosure is directed to an improvement in reel packages. The reel package of the present disclosure comprises opposing flange assemblies and a core that intersects and connects the flange assemblies. Each flange assembly comprises first and second parallel members having a connective material disposed in between them. One or more dowels are disposed at each end of the core so as to be present in between the parallel members and in contact with the connective material. The connective material sets and connects the parallel members of each flange assembly to form the reel, and holds the dowels in place relative to the core and the parallel members. The resulting reel package is extremely strong and is useful as a replacement reel package in many applications that use wood or metal reel packages that are reinforced by bolts or rods.

In the following detailed description, for purposes of explanation and not limitation, exemplary, or representative, embodiments disclosing specific details are set forth in order to provide a thorough understanding of an embodiment according to the present teachings. The word "exemplary" is used herein to mean "serving as an example, instance, or illustration." The word "representative" may be used herein synonymously with "exemplary." Any aspect described herein as "exemplary" is not necessarily to be construed as preferred or advantageous over other aspects. However, it will be apparent to one having ordinary skill in the art having the benefit of the present disclosure that other embodiments according to the present teachings that depart from the specific details disclosed herein remain within the scope of the appended claims. Moreover, descriptions of well-known apparatuses and methods may be omitted so as to not obscure the description of the example embodiments. Such methods and apparatuses are clearly within the scope of the present teachings.

The terminology used herein is for purposes of describing particular embodiments only and is not intended to be limiting. The defined terms are in addition to the technical and scientific meanings of the defined terms as commonly understood and accepted in the technical field of the present teachings.

As used in the specification and appended claims, the terms "a," "an," and "the" include both singular and plural referents, unless the context clearly dictates otherwise. Thus, for example, "a device" includes one device and plural devices.

Relative terms may be used to describe the various elements' relationships to one another, as illustrated in the accompanying drawings. These relative terms are intended to encompass different orientations of the device and/or elements in addition to the orientation depicted in the drawings.

It will be understood that when an element is referred to as being "connected to" or "coupled to" another element, it can be directly connected or coupled, or intervening elements may be present.

Alternative embodiments will become apparent to one of ordinary skill in the art to which the invention pertains. Therefore, although selected aspects have been illustrated and described in detail, it will be understood that various substitutions and alterations may be made therein.

FIG. 1 is a top perspective view of the reel package 1 of the present disclosure in accordance with a representative embodiment. As shown in FIG. 1, the reel package 1 of the present invention comprises a first flange assembly 3 positioned at one end of a center tube 2, and a second flange assembly 4 positioned at an opposite end of the center tube 2. The center tube 2 in most embodiments will be a wound paper tube, but may be formed of metal, plastics or other suitable materials. The first flange assembly 3 comprises first and second parallel members 3*a* and 3*b*, respectively. Likewise, the second flange assembly 4 comprises first and second parallel members 4*a* and 4*b*, respectively.

Although not visible in FIG. 1, in between the pairs of parallel members 3*a*, 3*b* and 4*a*, 4*b*, one or more dowel rods extend through the opposite ends of the center tube 2 parallel to the members 3*a*, 3*b*, 4*a* and 4*b* and are encased in a connective material that is also in contact with inner surfaces of the members 3*a*, 3*b*, 4*a* and 4*b*. The parallel members 3*a*, 3*b*, 4*a* and 4*b* can be made of any suitable, substantially rigid material, e.g., plywood, metal, plastic, etc.

Figure 2:
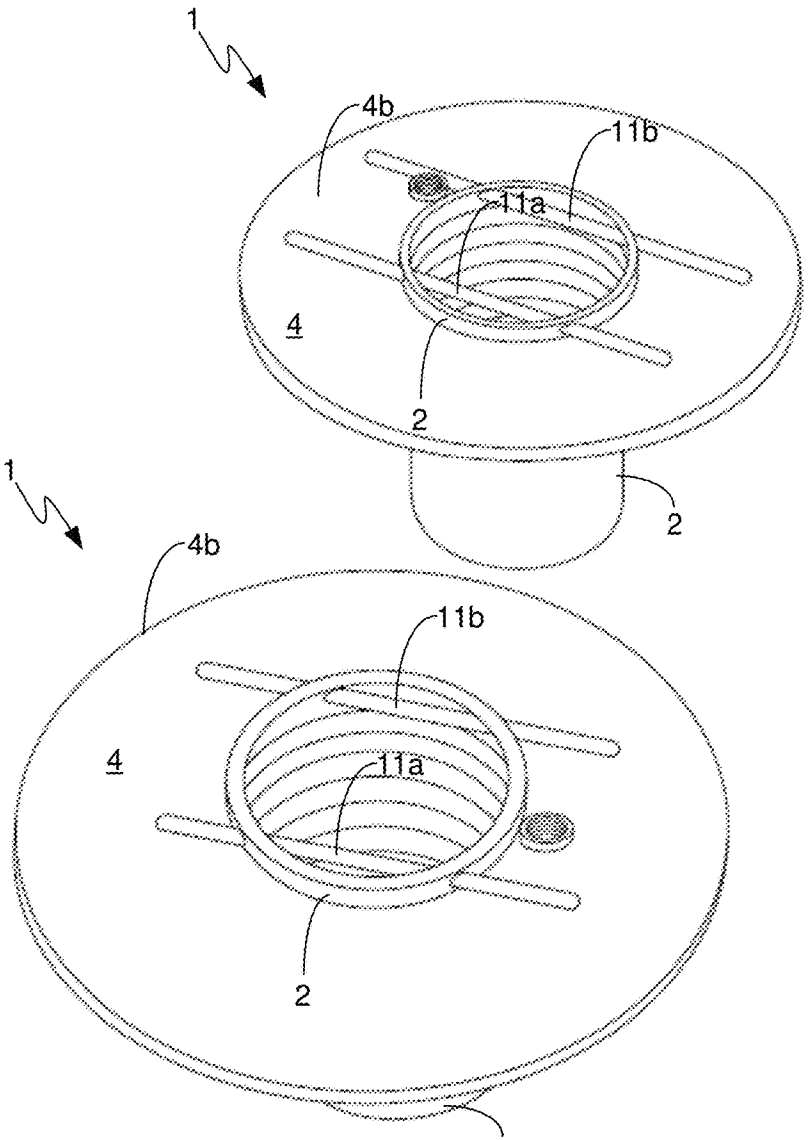
FIG. 2 is a perspective view of portions of the reel shown in FIG. 1 during a stage of the manufacturing process.

FIG. 2 is a perspective view of portions of two of the reel packages 1 shown in FIG. 1 during the assembly process before the flange assemblies 3 shown in FIG. 1 have been installed and before the second parallel member 4*a* shown in FIG. 1 has been installed. In accordance with this representative embodiment, pairs of dowel rods 11*a* and 11*b* are installed in each end of the center tube 2. Holes are formed near each end of the center tube 2 for passing the dowel rods 11*a*, 11*b* through the ends of the center tube 2. The dowel rods 11*a*, 11*b* extend in directions that are generally perpendicular to an axis of the center tube 2 and generally parallel to the parallel members 3*a*, 3*b*, 4*a*, 4*b*.

Holes formed in the parallel members 3*b* and 4*b* are slightly larger in diameter than the outer diameter of the center tube 2 so that the members 3*b*, 4*b* can be installed over the opposite ends of the center tube 2. During installation, the member 4*b* is temporarily held in place on the end of the center tube 2 by a frictional fit with the outer surface of the center tube 2. After the member 4*b* is installed over the center tube 2 as shown in FIG. 2, the dowel rods 11*a*, 11*b* are positioned within the holes formed near the end of the center tube 2.

Figure 3:
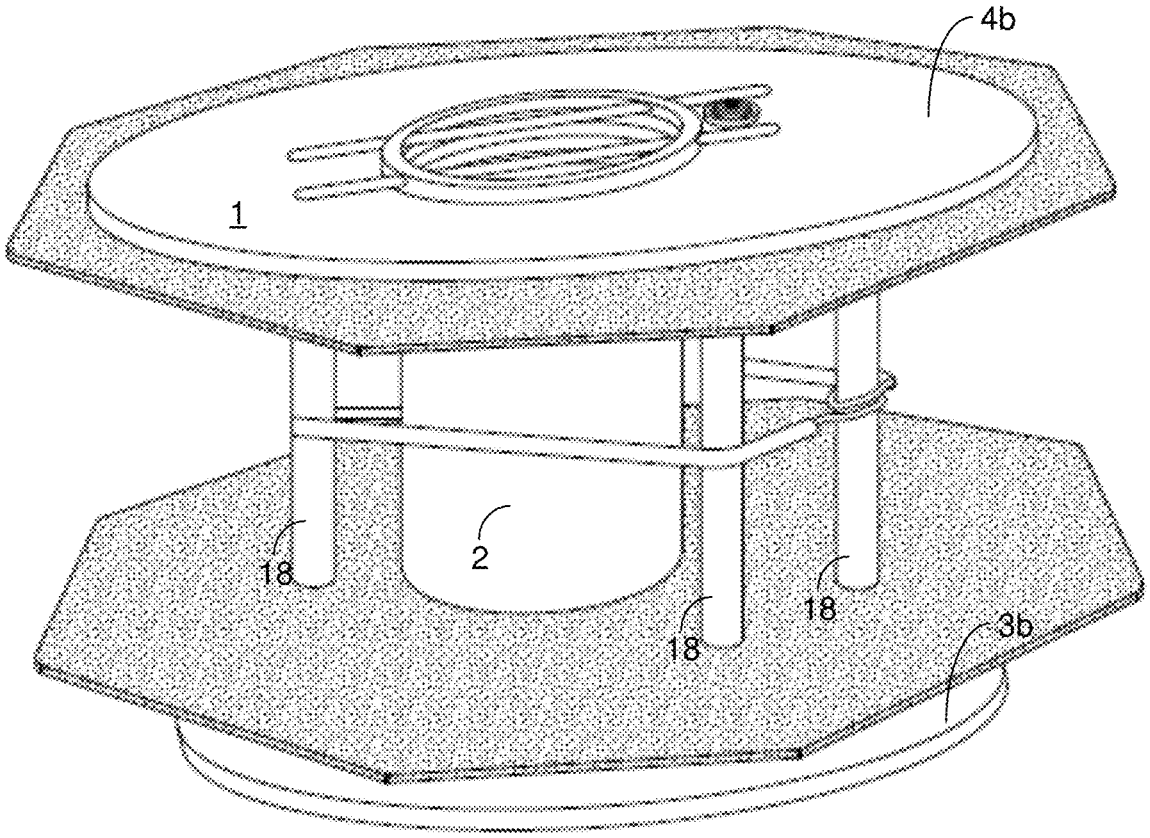
FIG. 3 is a perspective view of the reel shown in FIG. 1 during another stage of the manufacturing process.

FIG. 3 shows a perspective view of the reel 1 shown in FIG. 1 during the assembly process after the members 3*b*, 4*b* have been installed, but before the members 3*a*, 4*a* have been installed. After the members 3*b* and 4*b* have been installed on opposite ends of the center core 2 and the dowel rods 11*a*, 11*b* have been installed in the holes formed in the ends of the center tube 2, pegs 18 that are pre-cut to the appropriate length may be used to space the members 3*b* and 4*b* apart from one another by a predetermined distance and to provide structural support during the assembly process. The pegs 18 preferably are removed after the reel 1 has been fully assembled.

Figure 4:
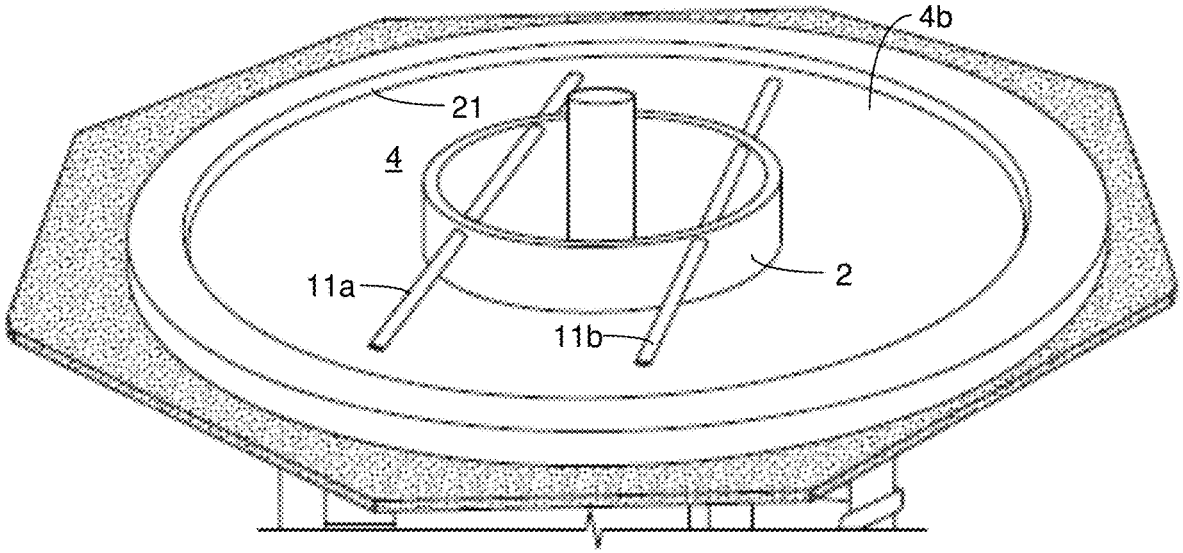
FIG. 4 is a perspective view of the reel shown in FIG. 1 during another stage of the manufacturing process in which preparation of the reel is made for introduction of a fluid connective material.

FIG. 4 is a top perspective view of the member 4*b* after it has been installed on the end of the center tube and the dowel rods 11*a*, 11*b* have been installed. A dam 21 is positioned over the member 4*b*. The dam 21 may be formed of paper, but may also be formed of plastic, metal or any other suitable material. In accordance with a preferred embodiment, the dam 21 has a diameter that is just slightly smaller than the outer diameters of the member 4*b*, as shown in FIG. 4. Surfaces of the member 44, the center tube 2 and the dam 21 form a cavity, or reservoir, as shown in FIG. 4. This reservoir is filled with a connective material having adhesive qualities. As indicated above, in accordance with a preferred embodiment, the connective material is expandable polyurethane foam. A polyurethane foam called INSTAPAK foam manufactured by Sealed Air Corporation can be used for this purpose, but any suitable material can be used for this purpose, as will be understood by those of skill in the art in view of the description provided herein. For exemplary purposes, it will be assumed hereinafter that the connective material is a fluid foam material that hardens into a solid state when it sets, or cures.

Figure 5:
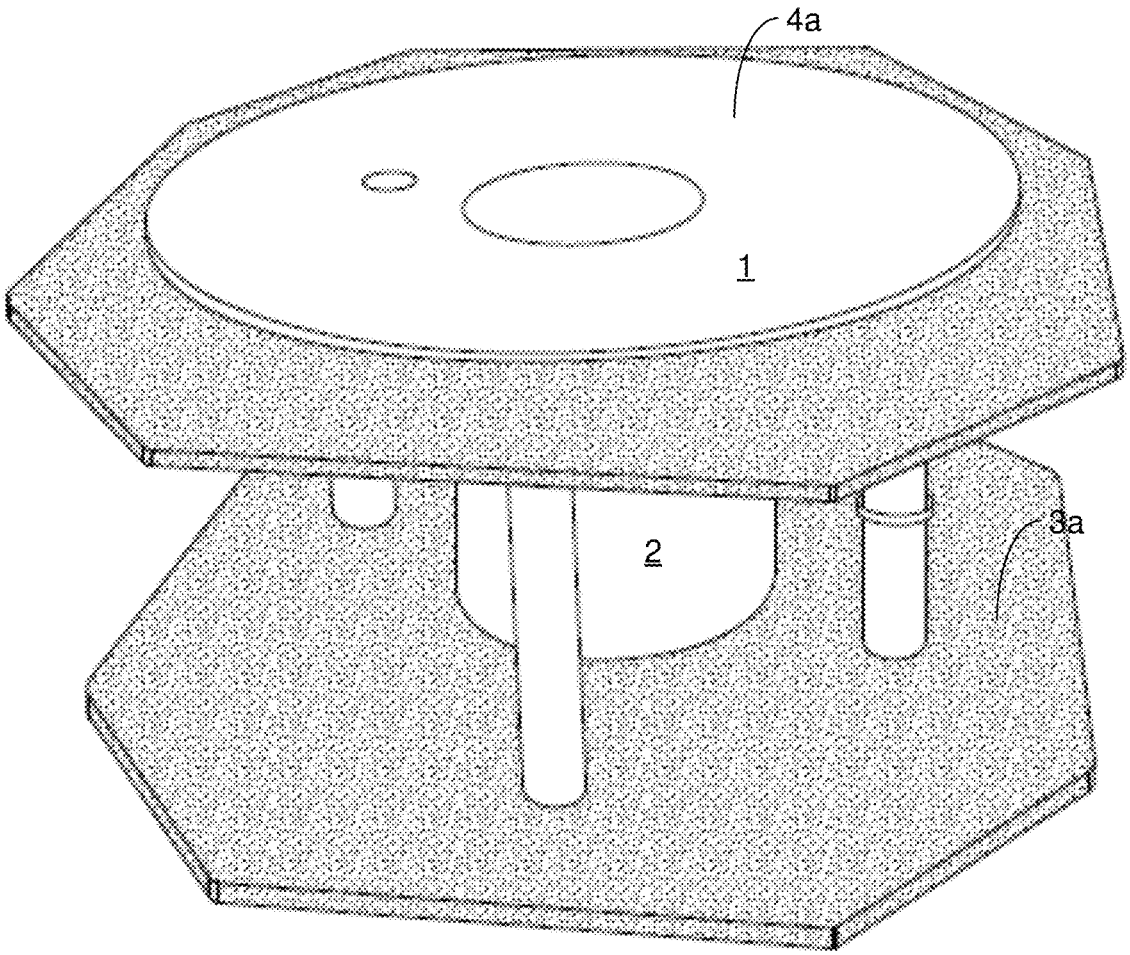
FIG. 5 is a perspective view of the reel shown in FIG. 1 during another stage of the manufacturing process.

FIG. 5 is a top perspective view of the reel 1 after the member 4*a* has been placed in contact with the fluid foam material contained in the reservoir. After an appropriate amount of fluid foam material has been positioned in the reservoir so as to fill it after the foam sets, the outer parallel member 4*a* is positioned on the fluid foam material, as shown in FIG. 5. The adhesive qualities of the fluid foam material attach the members 4*a* and 4*b* to one another and hold them in place when the fluid foam material sets. In addition, the fluid foam material adheres to the dowel rods 11*a*, 11*b* and holds them in place when it sets. The foam material also strengthens and cushions the dowel rods 11*a*, 11*b* so that they are less subject to shear or breaking. The combination of the dowel rods 11*a*, 11*b* sandwiched in between the parallel members 4*a*, 4*b* in the presence of the set foam material leads to the reel 1 having an unexpected strength and durability.

The fluid foam material preferably is a two-part material in which a chemical reaction occurs to cause the fluid material to set and become solid. The preferred polyurethane foam material sets as a solid to adhere the members 4*a*, 4*b* together and secure them and the dowel rods 11*a*, 11*b* to the center tube 2 while adding strength to the dowel rods 11*a*, 11*b*. The use of a fluid foam material, such as polyurethane foam, that is reactive and sets quickly leads to a fast and efficient reel manufacturing process. However, persons of skill in the art will understand, in view of the description provided herein, that other materials may be used for this purpose.

Figure 6:
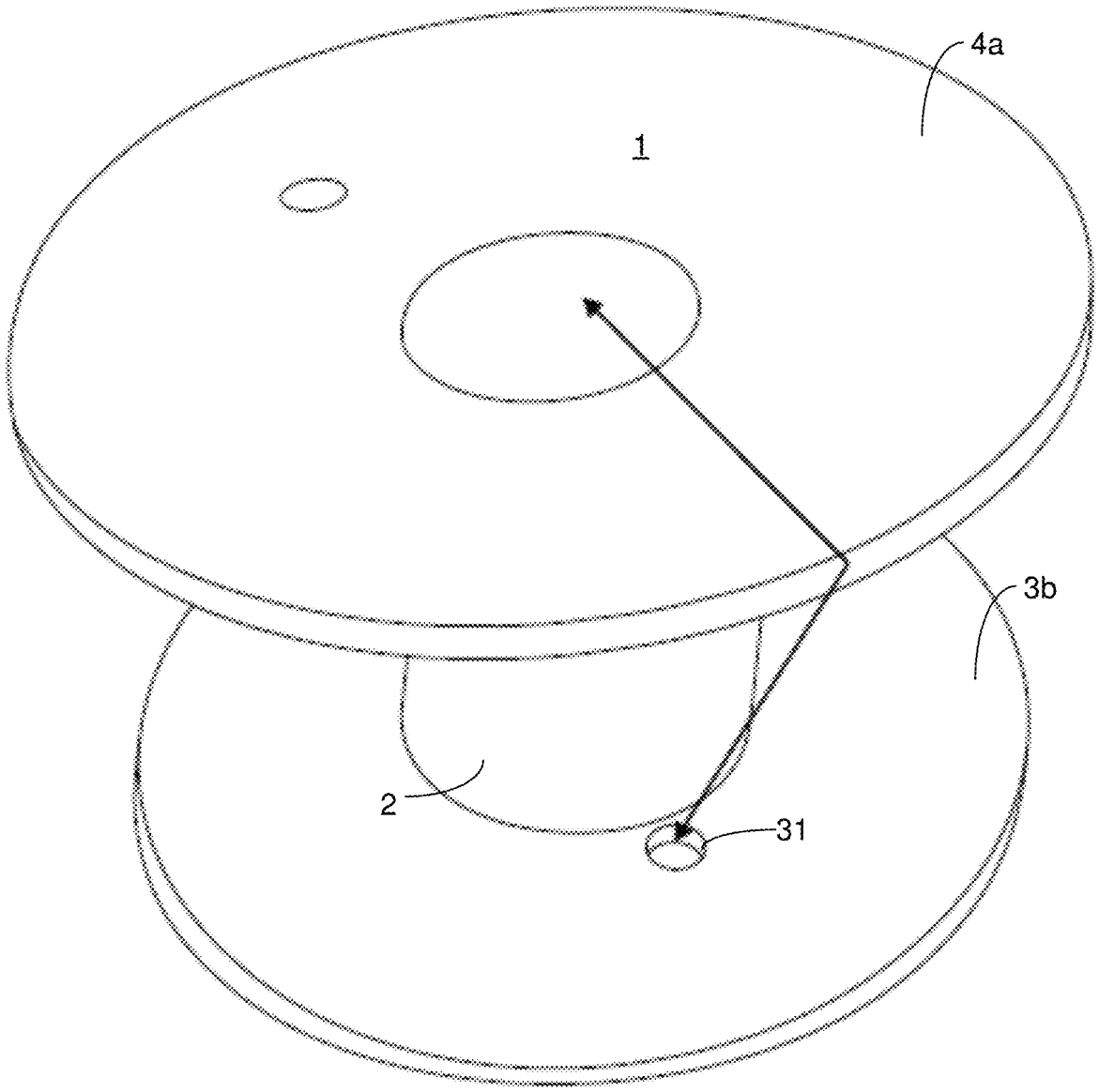
FIG. 6 is a perspective view of the reel shown in FIG. 1 during another stage of the manufacturing process.

FIG. 6 is a top perspective view of an assembly line having a plurality of the reels 1 disposed therein. As shown in FIG. 6, a plastic insert may be positioned within drive holes 31 formed in the members 3*a*, 3*b*, 4*a*, 4*b* to provide a mechanism for driving the reel 1 in winding or unwinding product from the reel 1. The insert could be formed of materials other than plastic, such as metal or paper, for example.

Figure 7:
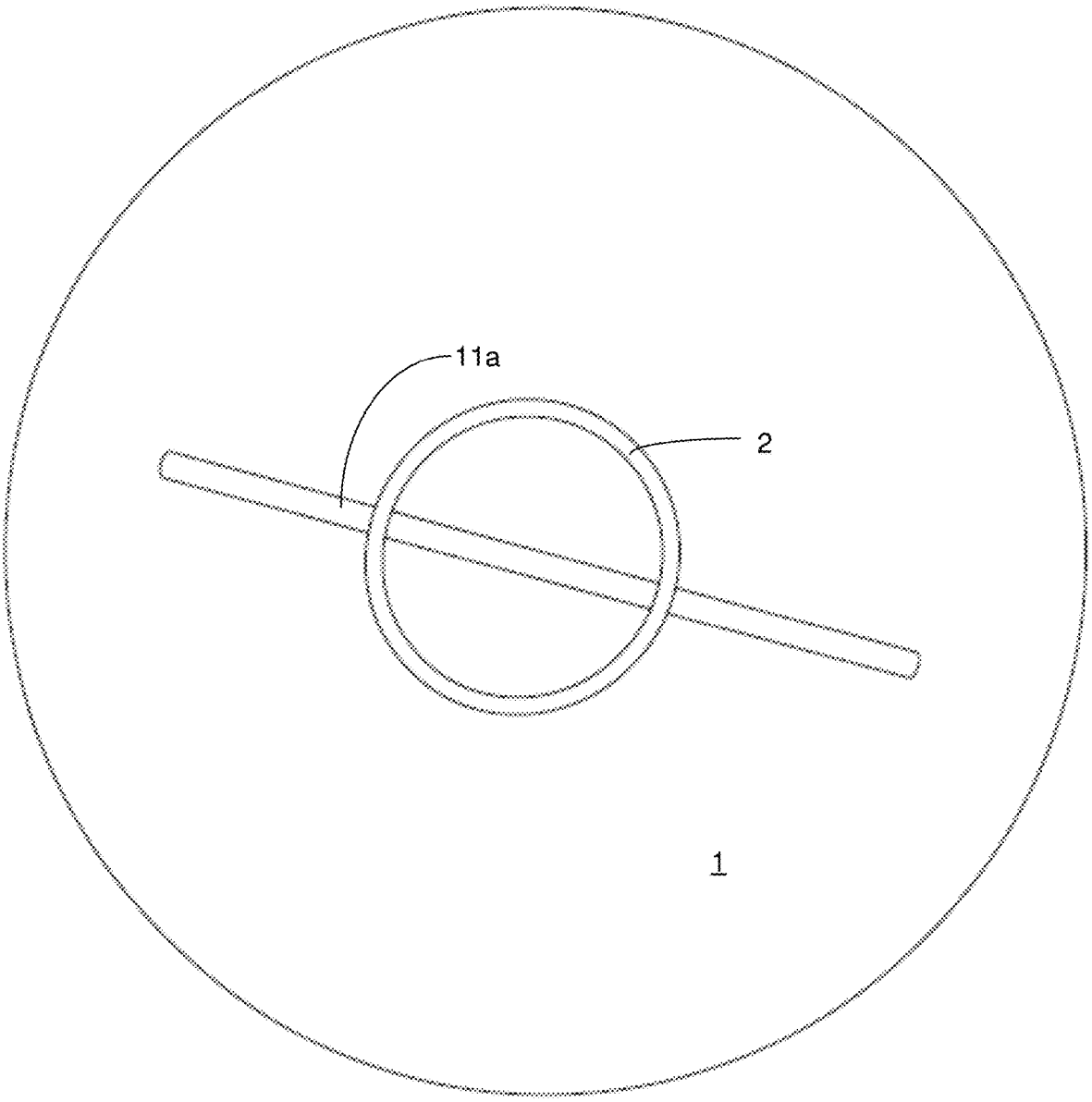
FIG. 7 is a top plan view of the reel shown in FIG. 1 in accordance with another representative embodiment.

FIG. 7 is a top plan view of the reel 1 in accordance with a representative embodiment in which a single dowel rod 11*a* is used in each end of the center tube 2. In the embodiment of FIG. 7, the single dowel rod 11*a* intersects substantially the center axis of the center tube 2 near the end of the center tube 2. The remainder of the assembly process for the embodiment of FIG. 7 is substantially the same as the assembly process described above with reference to FIGS. 1-6. The assembly process has been described above with reference to FIGS. 1-6 with respect to assembly of the flange assembly 4 on the end of the center tube 2, but the assembly process for flange assembly 3 can be performed in an identical manner.

It should be noted that while the dam 21 is shown in FIG. 3 and described above as being a device that is placed on the inner surfaces of parallel members 3*b* and 4*b*, it can be an integral part of the parallel members 3*b* and 4*b*. For example, a groove, ridge or raised area can be formed in or on the inner surfaces of parallel members 3*b* and 4*b* that will act as a dam.

It should be noted that while the process of manufacturing the reel 1 has been shown as a manual process, the process can readily be automated. Each of the steps described above can be performed by an automated assembly line, as will be understood by those of skill in the art in view of the description provided herein.

Figure 8:
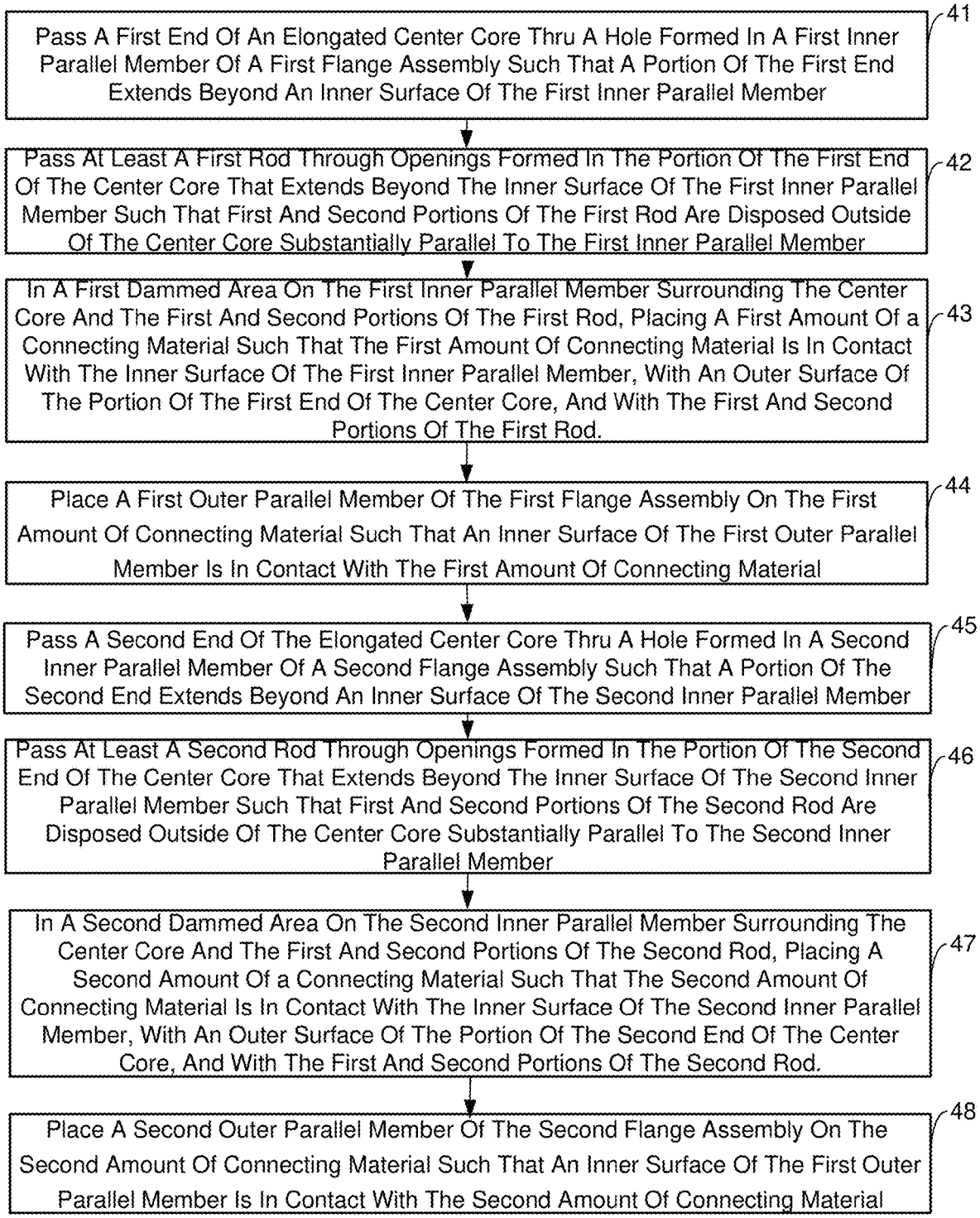
FIG. 8 is a flow diagram representing the method of manufacturing a reel in accordance with a representative embodiment.

FIG. 8 is a flow diagram that represents the process of manufacturing the reel 1 in accordance with a representative embodiment. Block 41 represents the step of passing a first end of an elongated center core thru a hole formed in a first inner parallel member of a first flange assembly such that a portion of the first end extends beyond an inner surface of the first inner parallel member. Block 42 represents the step of passing at least a first rod thru openings formed in the portion of the first end of the center core that extends beyond the inner surface of the first inner parallel member such that first and second portions of the first rod are disposed outside of the center core substantially parallel to the first inner parallel member. Block 43 represents the step of, in a first dammed area on the first inner parallel member surrounding the center core and the first and second portions of the first rod, placing a first amount of a connecting material such that the first amount of connecting material is in contact with the inner surface of the first inner parallel member, with an outer surface of said portion of the first end of the center core, and with the first and second portions of the first rod. Block 44 represents the step of placing a first outer parallel member of the first flange assembly on the first amount of connecting material such that an inner surface of the first outer parallel member is in contact with the first amount of connecting material.

Block 45 represents the step of passing a second end of the elongated center core thru a hole formed in a second inner parallel member of a second flange assembly such that a portion of the second end of the center core extends beyond an inner surface of the first inner parallel member. Block 46 represents the step of passing at least a second rod thru openings formed in the portion of the second end of the center core that extends beyond an inner surface of the second inner parallel member such that first and second portions of the second rod are disposed outside of the center core substantially parallel to the second inner parallel member. Block 47 represents the step of, in a second dammed area of the second inner parallel member that surrounds the center core and the first and second portions of the second rod, placing a second amount of the connecting material such that the second amount of the connecting material is in contact with the inner surface of the second inner parallel member, with an outer surface of the portion of the second end of the center core that extends beyond the inner surface of the second inner parallel member, and with the first and second portions of the second rod. Block 48 represents the step of placing a second outer parallel member of the second flange assembly on the second amount of the connecting material such that an inner surface of the second outer parallel member is in contact with the second amount of the connecting material.

Curing of the connecting material interconnects the first inner and outer parallel members of the first flange assembly and interconnects the second inner and outer parallel members of the second flange assembly. The curing process can be a passive process that requires no action on the part of the manufacturer.

It should be noted that the inventive principles and concepts are not limited to the process being performed in any particular order. The order depicted by the flow diagram of FIG. 8 is one example of the order in which the steps can be performed. For example, the steps represented by blocks 41-44 can be performed in parallel with the steps represented by blocks 45-48.

It should be noted that the invention has been described with reference to a few representative embodiments and that the inventive principles and concepts are not limited to the embodiments described herein. For example, many materials other than those mentioned herein can be used to make the reel. The materials discussed above are preferred because they allow the real or spool to be made relatively inexpensively, and relatively light in weight while also being extremely strong and durable.

What is claimed is:

1. A reel comprising:

first and second flange assemblies, the first flange assembly comprising first inner and outer parallel members and a first amount of connective material disposed in between inner surfaces of the first inner and outer members to interconnect the first inner and outer parallel members, the second flange assembly comprising second inner and outer parallel members and a second amount of connective material disposed in between inner surfaces of the second inner and outer parallel members to interconnect the second inner and outer parallel members;

a center core that interconnects the first and second flange assemblies, a first end of the center core extending beyond the inner surface of the first inner parallel member of the first flange assembly and being in contact with the first amount of connective material, a second end of the center core extending beyond the inner surface of the second inner parallel member of the first flange assembly and being in contact with the second amount of connective material; and at least first and second rods passing thru holes formed in the first and second ends, respectively, of the center core, wherein first and second portions of the first rod are positioned in between the inner surfaces of the first inner and outer parallel members and are in contact with the first amount of connective material, and wherein first and second portions of the second rod are positioned in between the inner surfaces of the second inner and outer parallel members and are in contact with the second amount of connective material.

2. The reel of claim 1, wherein the center core comprises a paper core.

3. The reel of claim 2, further comprising:

at least third and fourth rods passing thru holes formed in the first and second ends, respectively, of the center core, wherein first and second portions of the third rod are positioned in between the inner surfaces of the first inner and outer parallel members and are in contact with the first amount of connective material, and wherein first and second portions of the fourth rod are positioned in between the inner surfaces of the second inner and outer parallel members and are in contact with the second amount of connective material.

4. The reel of claim 2, wherein the connective material comprises a foam material.

5. The reel of claim 4, wherein the foam material has adhesive characteristics that cause the inner surfaces of the first inner and outer parallel members to adhere to the foam material and causes the inner surfaces of the second inner and outer parallel members to adhere to the foam material.

6. The reel of claim 2, wherein the first and second inner and outer parallel members comprise wood.

7. The reel of claim 2, wherein the first and second inner and outer parallel members comprise metal.

8. The reel of claim 2, wherein the first and second inner and outer parallel members comprise plastic.

9. The reel of claim 1, wherein the center core comprises a metallic core.

10. The reel of claim 1, wherein the center core comprises a plastic core.

11. A method of making a spool or a reel comprising:

passing a first end of an elongated center core through a hole formed in a first inner parallel member of a first flange assembly such that a portion of the first end extends beyond an inner surface of the first inner parallel member;

passing at least a first rod through openings formed in said portion of the first end of the center core such that first and second portions of the first rod are disposed outside of the center core substantially parallel to the first inner parallel member;

in a first dammed area on the first inner parallel member surrounding the center core and the first and second portions of the first rod, placing a first amount of a connecting material such that the first amount of connecting material is in contact with the inner surface of the first inner parallel member, with an outer surface of said portion of the first end of the center core, and with the first and second portions of the first rod;

placing a first outer parallel member of the first flange assembly on the first connecting material such that an inner surface of the first outer parallel member is in contact with the first connecting material;

passing a second end of the elongated center core through a hole formed in a second inner parallel member of a second flange assembly such that a portion of the second end of the center core extends beyond an inner surface of the first inner parallel member;

passing at least a second rod through openings formed in said portion of the second end of the center core such that first and second portions of the second rod are disposed outside of the center core substantially parallel to the second inner parallel member;

in a second dammed area of the second inner parallel member surrounding the center core and the first and second portions of the second rod, placing a second amount of the connecting material such that the second amount of the connecting material is in contact with the inner surface of the second inner parallel member, with an outer surface of said portion of the second end of the center core, and with the first and second portions of the second rod; and placing a second outer parallel member of the second flange assembly on the second amount of the connecting material such that an inner surface of the second outer parallel member is in contact with the second amount of the connecting material, wherein curing of the connecting material interconnects the first inner and outer parallel members and interconnects the second inner and outer parallel members.

12. The method of claim 11, wherein the center core comprises a paper core.

13. The method of claim 12, wherein the step of passing at least a first rod thru openings formed in said portion of the first end of the center core includes passing the first rod and a third rod thru openings formed in said portion of the first end of the center core such that first and second portions of the first and third rods are disposed outside of the center core substantially parallel to the first inner parallel member.

14. The method of claim 13, wherein the step of passing at least a second rod thru openings formed in said portion of the second end of the center core includes passing the second rod and a fourth rod thru openings formed in said portion of the second end of the center core such that first and second portions of the second and fourth rods are disposed outside of the center core substantially parallel to the second inner parallel member.

15. The method of claim 12, wherein the connective material comprises a foam material.

16. The method of claim 15, wherein the foam material has adhesive characteristics that cause the inner surfaces of the first inner and outer parallel members to adhere to the foam material and causes the inner surfaces of the second inner and outer parallel members to adhere to the foam material.

17. The method of claim 12, wherein the first and second inner and outer parallel members comprise wood.

18. The method of claim 12, wherein the first and second inner and outer parallel members comprise metal.

19. The method of claim 12, wherein the first and second inner and outer parallel members comprise plastic.

20. The method of claim 11, wherein the center core comprises at least one of metal and plastic.

* * * * *